US006972569B2

(12) United States Patent
McQueeney

(10) Patent No.: US 6,972,569 B2
(45) Date of Patent: Dec. 6, 2005

(54) WASTE-POWER KV SIMULATOR FOR HYBRID/DIS IGNITION

(75) Inventor: Kenneth A. McQueeney, Los Gatos, CA (US)

(73) Assignee: Snap-On Incorporated, Pleasant Prairie, WI (US)

( * ) Notice: Subject to any disclaimer, the term of this patent is extended or adjusted under 35 U.S.C. 154(b) by 30 days.

(21) Appl. No.: 10/804,222

(22) Filed: Mar. 19, 2004

(65) Prior Publication Data

US 2005/0012503 A1 Jan. 20, 2005

Related U.S. Application Data

(60) Provisional application No. 60/456,233, filed on Mar. 21, 2003.

(51) Int. Cl.[7] ..... F02P 17/00; F02P 11/00
(52) U.S. Cl. ..... 324/388; 324/380; 123/630
(58) Field of Search ..... 324/388, 380, 324/383; 123/630

(56) References Cited

U.S. PATENT DOCUMENTS

| | | | | |
|---|---|---|---|---|
| 1,873,121 A | | 8/1932 | Hartzell | 324/383 |
| 4,385,278 A | * | 5/1983 | Sterling | 324/381 |
| 5,175,501 A | | 12/1992 | Loewe et al. | 324/380 |
| 5,479,101 A | * | 12/1995 | Chang | 324/388 |
| 5,641,898 A | | 6/1997 | Chang | 73/118.1 |
| 6,396,277 B1 | | 5/2002 | Fong et al. | 324/402 |
| 6,842,007 B2 | * | 1/2005 | Butler et al. | 324/378 |
| 2003/0038635 A1 | | 2/2003 | McQueeney et al. | 324/388 |

* cited by examiner

*Primary Examiner*—Anjan Deb
*Assistant Examiner*—Amy He
(74) *Attorney, Agent, or Firm*—McDermott Will & Emery LLP

(57) ABSTRACT

A testing apparatus for testing a waste-power ignition coil is provided and includes an igniter simulator having a first switching device electrically connected to an output of the primary side of a waste-power ignition coil under test and a triggering means for changing a state of the first switching device at a predetermined interval. A second switching device bears a first pair of contacts being electrically connected to one of a positive going and negative going output of a secondary winding of the waste-power ignition coil under test and a second pair of contacts being electrically connected to another of a positive going and negative going output of the secondary winding of the waste-power ignition coil under test. The second switching device acts substantially synchronously with the igniter simulator actuator to ground a respective one of the positive going and negative going output of the secondary winding of the waste-power ignition coil under test to simulate a waste-stroke phase.

18 Claims, 4 Drawing Sheets

WASTE-POWER KV SIMULATOR FOR HYBRID/DIS IGNITION

CROSS REFERENCE TO RELATED APPLICATIONS

This application claims priority from and is related to U.S. Provisional Application No. 60/456,233, filed Mar. 21, 2003, entitled "WASTE-POWER KV SIMULATOR FOR HYBRID/DIS IGNITION", by inventor Kenneth A. McQueeney. The contents of the provisional application are hereby incorporated by reference in its entirety.

BACKGROUND

1. Field

This patent application is directed to the field of ignition coils. It is more specifically directed to simulation of an engine environment for the purpose of testing the operation of distributorless ignition coils, particularly of the direct ignition system (DIS) and hybrid DIS variety.

2. Description of Related Art

Ignition coils are commonly used to boost a low voltage supply voltage to the very high voltage level that is necessary to ignite a spark. As is well known, the boosted voltage is usually delivered to a spark plug, typically installed in a combustion engine. The spark ignites fuel, causing increased pressure in the cylinder in which the spark plug is mounted, resulting in movement of the piston within the cylinder.

The ignition coil itself is, essentially, a transformer having a very large turn ratio, typically between 1:50 to 1:100, between the primary and secondary, which transforms the low voltage in a primary winding provided by the sudden opening of the primary current to a high voltage in a secondary winding. In older ignition systems, the ignition coil is connected to the center or coil terminal of a distributor cap by an insulated wire. High voltage from the ignition coil is distributed from the coil terminal to side or spark plug terminals of the distributor cap by means of a rotor. As the tip of the rotor spins in the cap past a series of contacts (one contact per cylinder), a high-voltage pulse from the coil arcs across the small gap between the rotor and the contact and continues down the spark-plug wire to the spark plug on the appropriate cylinder, thus distributing the spark to each spark plug terminal at a predetermined timing.

More recently, ignition systems have evolved to "distributorless" ignition systems having one coil per cylinder (e.g., conventional coil-on-plug (COP)) or one coil per cylinder pair (e.g., a direct ignition system (DIS) or Hybrid). These distributorless ignition systems are conventional and widely known. Distributorless ignition systems, as the name implies, do not utilize distributor caps and rotor and, instead, incorporate an ignition coil over each plug (or plug pair) or an ignition coil near each plug (coil near plug or CNP)(or plug pair). The ignition coil generates the high voltage and supplies it only to the single spark plug (e.g., COP) or spark plug pair (e.g., DIS or Hybrid) with which it is associated. Coil-on-plug (COP) ignitions generally comprise a spark coil integrally mounted on spark plug, which protrudes into and is mounted in an engine cylinder and terminates in spark gap. The spark coil conducts transformed, high voltage direct current to the spark plug using internal connections. The coil receives low voltage direct current via a wiring harness that has a distal end coupled to a primary coil of the coil and a proximal end coupled to a battery.

Some distributorless ignition systems (e.g., Hybrid) are configured so that one of the two plugs in the pair is buried or otherwise inaccessible (e.g., one plug is a COP), whereas other distributorless ignition systems (e.g., DIS) are configured so that both plugs in the pair are accessible. For example, in the Hybrid ignition system, the ignition coil may be connected to one spark plug by a conventional ignition wire and to the other companion spark plug by means of a direct connection (e.g., a COP connection, such as a rigid extension or bus protruding from the bottom of the ignition coil to the spark plug). Thus configured, the DIS and Hybrid simultaneously generate and output two different high voltage signals and associated electric near fields. As known to those of ordinary skill in the art, it is with these electric near fields that an appropriately configured sensor, such as but not limited to that shown in U.S. Pat. No. 6,396,277, the content of which is incorporated herein by reference, may be used to develop waveforms of the ignition cycle to aid in detection of and diagnosis of ignition system anomalies.

However, before a DIS or Hybrid ignition coil is even installed in an engine, it must be tested to ensure proper operation. Otherwise, a detected fault within the ignition system could be the ignition coil itself and not the elements of the system that are being tested. Currently, the only way to test such an ignition coil is to install the ignition coil on a properly running engine having duly tested and certified ignition system components. The ignition coil is installed in the engine and the engine is operated to conduct the test of the ignition coil. Outputs of the coil are observed to determine if the proper power levels are being output by the ignition coil. Thus, the engine is presently necessary to test the operation of the ignition coil under operating conditions, a limitation which renders the testing cumbersome and inconvenient. A need therefore exists for an improved testing method and apparatus which eliminates the need for an engine to conduct the ignition coil testing.

SUMMARY

This disclosure relates to a system for simulating the operation of a distributorless ignition coil, particularly of DIS of Hybrid (e.g., "waste-spark" or "waste-power") ignition coils, to facilitate testing of the ignition coil. The system simulates the operating parameters of an ignition coil without the need for using an actual engine.

In one aspect, a testing apparatus for testing a waste-power ignition coil, includes a first power source connectable to a primary side of a waste-power ignition coil under test and an ignition simulator comprising an actuator and a switching device having a first state, in which an output of the primary side of a waste-power ignition coil under test is electrically connected to ground to permit current to flow through the primary winding and having a second state, in which the output of the primary side of a waste-power ignition coil under test is electrically disconnected from ground to prevent current flow through the primary side of the waste-power ignition coil under test. A distributor is also provided and comprises a rotor and a rotor cap, the rotor cap comprising a plurality of contacts, a first pair of opposing contacts being electrically connected to a first output of the secondary side of the waste-power ignition coil under test and a second pair of opposing contacts being electrically connected to a second output of the secondary side of the waste-power ignition coil under test. The rotor comprises a point at a distal end thereof disposed to travel adjacent each of the plurality of distributor rotor cap contacts and to be separated therefrom by a predetermined rotor gap. A second power source powers a motor connected thereto and a motor output shaft rotates the actuator and rotor. The actuator is disposed proximal to the switching device to switch the switching device between the first state and the second state in accord with a rotation of the actuator. The rotor acts synchronously with the actuator to ground a respective one of first output and the second output of the secondary side of the waste-power ignition coil under test to simulate a waste-stroke phase for an associated spark plug and to provide a voltage from another of the first output and the second output of the secondary side of the waste-power ignition coil under test to simulate a power-stroke phase for an associated spark plug.

In another aspect, a testing apparatus for testing a waste-power ignition coil includes an igniter simulator comprising a first switching device electrically connected to an output of the primary side of a waste-power ignition coil under test and a triggering means for changing a state of the first switching device at a predetermined interval. The testing apparatus also includes a second switching device bearing a first pair of contacts being electrically connected to one of a positive going and negative going output of a secondary winding of the waste-power ignition coil under test and a second pair of contacts being electrically connected to another of a positive going and negative going output of the secondary winding of the waste-power ignition coil under test. In this testing apparatus, the second switching device acts substantially synchronously with the igniter simulator actuator to ground a respective one of the positive going and negative going output of the secondary winding of the waste-power ignition coil under test to simulate a waste-stroke phase.

In yet another aspect, a method for testing a waste-power ignition coil, includes the steps of electrically connecting an input terminal of a waste-power ignition coil primary coil to a power supply, electrically connecting a first switching device to an output terminal of the waste-power ignition coil primary coil, electrically connecting a negative going output of the waste-power ignition coil to a first spark plug, electrically connecting a positive going output of the waste-power ignition coil to a second spark plug, and electrically connecting a second switching device to each of the positive going output of the waste-power ignition coil and the negative going output of the waste-power ignition coil. The method also includes operating the first switching device to intermittently, at a pre-selected interval, connect the output of the waste-power ignition coil primary coil to ground and operating the second switching device to, substantially simultaneously with the operation of the first switching device, intermittently and alternately ground the positive going output and the negative going output of the waste-power ignition coil to simulate a waste-stroke phase for the grounded output and associated spark plug and to simulate a power-stroke phase for the non-grounded output.

Additional advantages will become readily apparent to those skilled in this art from the following detailed description, wherein only preferred examples of the present concepts are shown and described. As will be realized, the disclosed concepts are capable of other and different embodiments, and its several details are capable of modifications in various obvious respects, all without departing from the spirit thereof. Accordingly, the drawings and description are to be regarded as illustrative in nature, and not as restrictive.

Figure 1:
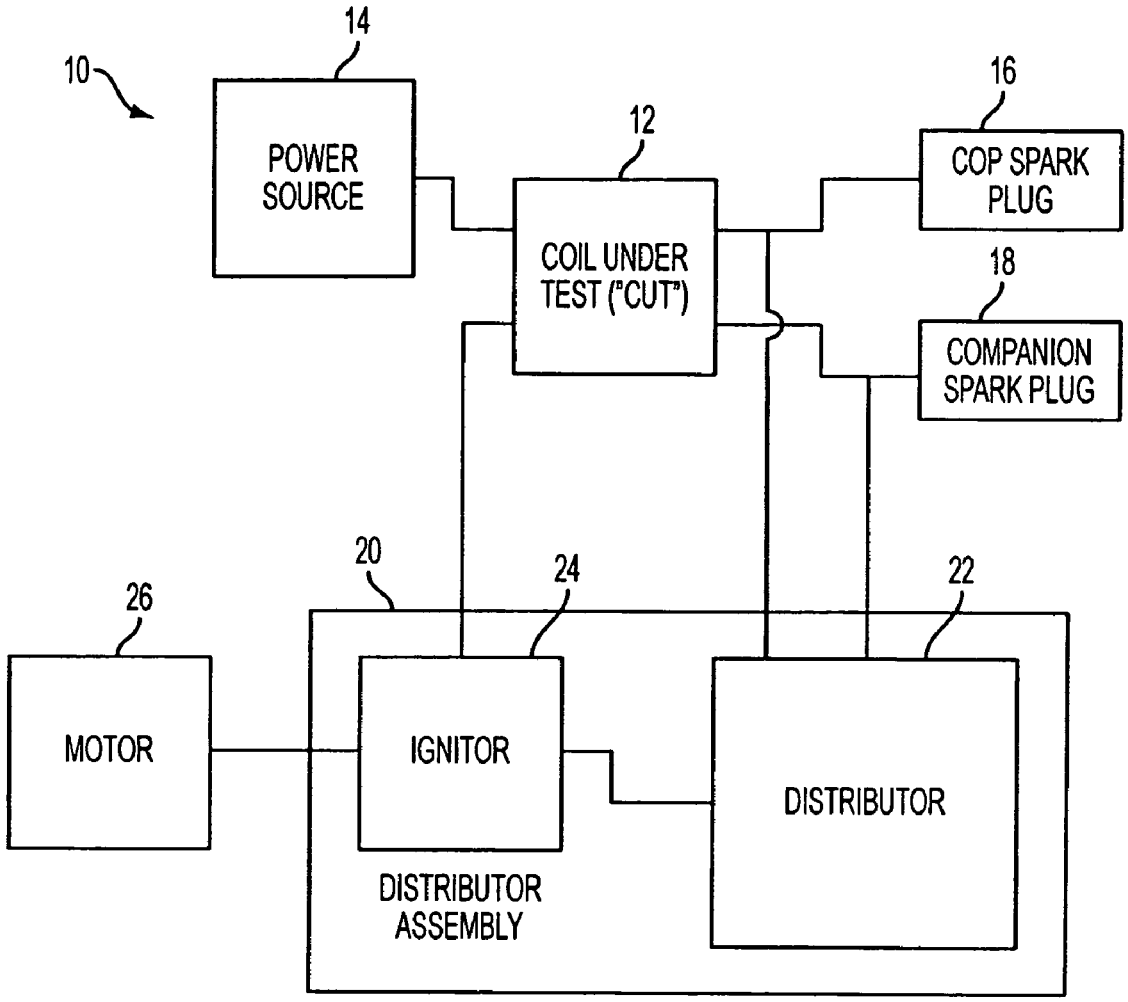
FIG. 1 is a block diagram of the simulation system for testing an ignition coil.

The figures referred to herein are examples provided and drawn for clarity of illustration and are not intended to be limiting in any way. The figures are not necessarily drawn to scale and are not necessarily inclusive of every feature or aspect of the objects or concepts featured therein. Elements having the same reference numerals refer to elements having similar structure and function.

DETAILED DESCRIPTION

Embodiments described herein or otherwise in accord with the concepts presented herein may include or be utilized with any appropriate voltage source, such as a battery, an alternator and the like, providing any appropriate voltage such as, but not limited to, about 9 Volts, about 12 Volts, about 42 Volts and the like.

During normal operation of an internal combustion engine having a DIS or Hybrid ignition system, each side of the ignition coil secondary winding is connected to a separate spark plug of a pair of plugs. As is known, the cylinders associated with the pair of spark plugs operate in a reciprocal manner. When the cylinder containing the first plug is on its compression stroke or power stroke, the other spark plug is on its exhaust stroke or waste stroke. Hence, these types of DIS and Hybrid ignition coils, and related coils and assemblies, may be generally referred to as "waste spark" or "waste-power" ignition coils or ignition systems. Conversely, when the cylinder containing the first plug is on its exhaust stroke, the other spark plug is on its power stroke.

In a normally performing engine, the power stroke firing line (an event wherein the delivery of the secondary voltage to the spark plug gap causes ionization across the spark plug gap and arcing across the electrodes to produce a spark to initiate combustion in the fuel-laden, pressurized cylinder) is in the order of approximately 6–8 KVp (peak KV). The waste-stroke or exhaust stroke firing line in the companion cylinder is typically on the order of about 2–4 KVp.

The ignition waveforms are conveniently sensed using a capacitive or inductive signal detector or detectors, such as the signal detector described in U.S. Pat. No. 6,396,277, the entire content of which is incorporated herein by reference. The selected signal detector may comprise, for example, a conventional capacitive adapter or capacity coupled adapter such as, but not limited to, Snap-On® COP-1 through COP-9 adapters (EETM306A03 through EETM306A13), Vantage® kV Module CIC adapters, Vantage® kV clips, Modis® kV clips, Snap-On® spring clip, Snap-On® universal clip, Snap-On® magnetic mount adapter, DIS tester HV wire clip, Bosch® HV wire clip, Snap-Ong flags, or Snap-On® hybrid adapters. These signal detectors may be connected to any conventional engine analyzer, lab scope, ignition scope, or display, such as but not limited to a Snap-On® Vantage®/KV Module (EETM306A) or Snap-On® MODIS® module, using an appropriately configured signal output device or cable (e.g., a Snap-On® cable EETM306A01 or 6-03422A, Rev. D, for the above diagnostic devices).

FIG. 1 is a block diagram of a testing apparatus or simulation system 10 which presents, to the ignition coil under test ("CUT") 12, the relevant characteristics that would normally be experienced by the ignition coil under actual operating conditions. FIG. 1 shows a simulation system 10 in accord with the present concepts, wherein an ignition coil under test ("CUT") 12 is coupled to power source 14 and is coupled to spark plugs 16, 18 by output lines 62, 58, respectively. A distributor assembly 20, including a distributor 22 and an ignition simulator 24, are also shown. Electrical connectors connect the distributor 22 to the CUT 12 output lines 62, 58. The distributor 22 and ignition simulator 24 are optionally connected to and driven by a motor 26 (powered by a power source (not shown)), as further described below.

Power source 14 may include a +14.0 VDC source (or other pre-selected voltage appropriate to the particular ignition coil under test), which may be a car battery under charge, a high power DC power supply, a battery charger, or other fixed or variable DC power source. It is preferred that the power source 14 be limited to a voltage drop of less than about 0.15 VDC from a pre-selected operating voltage during operation of the simulation system 10.

Figure 2:
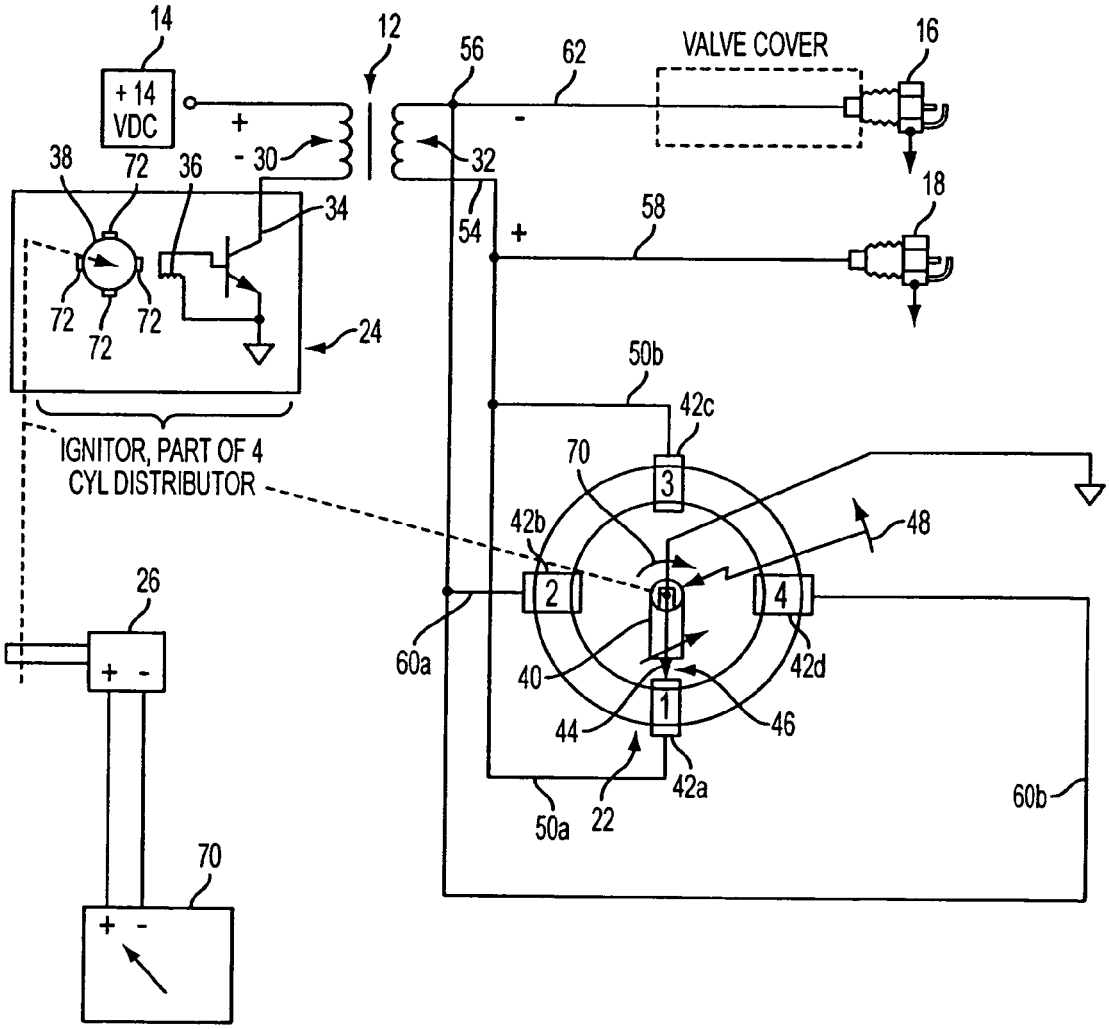
FIG. 2 is a schematic diagram of one example of a simulation system of FIG. 1 in accord with the present concepts.

As shown in greater detail in FIG. 2, spark plug 16 is disposed in a conventional coil-over-plug ("COP") configuration, wherein the spark plug is rendered inaccessible due to a valve cover, and is connected to a negative going output 62 of the CUT 12 secondary winding 32. Spark plug 18 (companion spark plug), which is accessible, is connected to the positive going output 58 of the secondary winding 32.

The operation of the simulation system 10 will be described with reference to FIG. 2. The positive terminal of power source 14 is connected to one side of the primary winding 30 of the CUT 12. The second side or output side of the primary winding 30 is connected to a switching device, such as a FET 34, included within the ignition simulator 24. An inductor 36 is connected to the control terminal of the switch 34 and receives an input from an actuator 38. In the illustrated example, the actuator 38 is a 4-pole 72 magnetic gear wheel disposed about an output shaft of DC motor 26 so as to rotate or move with respect to the stationary inductor 36. The rotating magnetic poles 72 induce current flow in inductor 36, which provides a voltage to power the FET 34, in a manner that can be readily appreciated by one of ordinary skill in the art. When switch (e.g., FET) 34 is closed, the voltage from power supply 14 is applied to primary winding 30, resulting in the stepped up voltage being output from secondary winding 32. When switch 34 is open, the voltage from power source 14 does not pass through primary winding 30 and no stepped up voltage is output from secondary winding 32.

Other conventional means may be used to intermittently and periodically connect the output side of the primary winding 30 to ground including, but not limited to a solid-state system which omits the motor 26 and magnetic gear wheel, and a mechanical system which omits the FET in favor of a mechanical switch. Actuator 38 comprises any mechanical, electrical, and electromechanical means by which a switch may be biased into and out of a state wherein the output side of the primary winding 30 is connected to ground.

Distributor 22 may comprise, in one aspect, a four cylinder, external coil type of distributor. Since only one ignition coil 12 is tested at a time, this configuration provides the necessary testing conditions, regardless of the number of cylinders in the engine in which the ignition coil will be used. However, the present concepts include distributors 22 adapted for use with a different number of cylinders.

Distributor 22 includes rotor 40 and contacts 42*a*–42*d*. As indicated in FIG. 2, contact 42*a* represents position 1 of the distributor, contact 42*b* represents position 2, contact 42*c* represents position 3 and contact 42*d* represents position 4. The rotor spark gap 46, or distance between the rotor and 40 and contacts 42*a*–42*d*, may optionally be adjusted by relative movement of an adjustable rotor point 44 and/or by movement of contacts 42*a–d* to vary the waste stroke spark voltage, described in more detail below. The rotor 40 is connected to ground at its point of rotation 48.

Contacts 42*a* and 42*c*, representing positions 1 and 3, respectively, are coupled together through spark plug wires 50*a* and 50*b* and then to side 54 of the secondary winding 32, which side receives the positive-going output voltage of the secondary winding 32. This side 54 is also connected to companion spark plug 18 through a conventional spark plug wire 58.

Contacts 42*b* and 42*d*, representing positions 2 and 4, respectively, are coupled together through spark plug wires 60*a* and 60*b* and then to second side 56 of the secondary winding 32, which side receives the negative-going output voltage of the secondary winding 32. This second side 56 is also connected to COP spark plug 16 through a conventional spark plug wire 62.

The configuration described above insures that, when the rotor 40 is at positions 1 and 3, the a first side 54 (e.g., a positive going side, as shown in FIG. 2) of secondary winding 32 is connected to ground 48 through the rotor 40, representing the waste stroke of the cylinder associated with companion spark plug 18. When the rotor 40 is at positions 2 and 4, the second side 56 (e.g., a negative going side, as shown in FIG. 2) of secondary winding 32 is connected to ground 48 through the rotor 40, representing the waste stroke of the cylinder associated with COP spark plug 16.

As illustrated, motor 26 is connected to the distributor rotor 40 to rotate the rotor synchronously with the actuator 38. Motor 26 may be a conventional DC motor powered by an appropriate power supply 70 (e.g., a 0–10V, 10 A adjustable supply). Alternatively, the DC motor 26 may be powered by the same power supply 14 provided to power the primary winding 30 of the CUT 12. It bears emphasizing that the use of a motor 26 with the presently disclosed testing apparatus or simulation system 10 is not necessary. Instead, the actuator 38 and rotor 40 may be disposed on a shaft that may be manually turned (i.e., no motor) at any desired rate. In this manner, each individual ignition or spark event may be manually controlled, one event at a time. Still further, even in a testing apparatus equipped with a motor 26, the motor output shaft may itself be manually manipulated to the same effect. This low speed operation is not possible on any conventional engine-mounted testing apparatus.

To facilitate use of the secondary winding outputs of the CUT 12 in a manner which simulates the operation of a running engine, it is preferred that certain component parameters of the simulation system 10 be adjusted. For example, in the illustrated Hybrid system, the gaps of the COP spark plug 16 and the companion spark plug 18 are set at a width which causes the average breakdown voltage of the spark plug (i.e., firing line) to be in the range of about 6–10 KVp, and still more preferably about 7 KVp. The rotor spark gap 46 is adjusted to obtain an average waste power of between about 2–4 KVp, as still more preferably about 3 KVp. These parameters represent voltages that would occur in a normally operating ignition system.

To conduct the simulation, the DC motor 26 output shaft is rotated, by hand or under power, in the clockwise direction indicated by arrow 70 to rotate the rotor 40 and actuator (e.g., magnetic gear wheel) 38 connected thereto. As noted above, actuator 40 comprises, in the illustrated example, four magnets 72 located proximate inductor 36 so that, at selected degrees of rotation of the DC motor 26 output shaft, a magnet 72 position coincides not only with the inductor 36 at the same time or substantially the same time that the rotor point 44 position coincides with one of the four contacts 42*a–d* of distributor 22. As rotor 40 is rotated through positions 1–4, the voltage available on the first side 54 and second side 56 of the secondary winding 32 is alternately and selectively shunted to ground to simulate a waste-stroke phase for the spark plug (e.g., spark plug 18 on the first side 54 and spark plug 16 on the second side 56) associated with that shunted side. The voltage from the other one of the first side 54 and second side 56 of the secondary winding 32 is available to a respective one of the COP spark plug 16 and the companion spark plug 18 to simulate a power-stroke phase therefor. In the configuration shown in FIG. 2, the COP spark plug 16 receives the negative-going output voltage and the companion spark plug 18 receives the positive-going output voltage.

Figure 3:
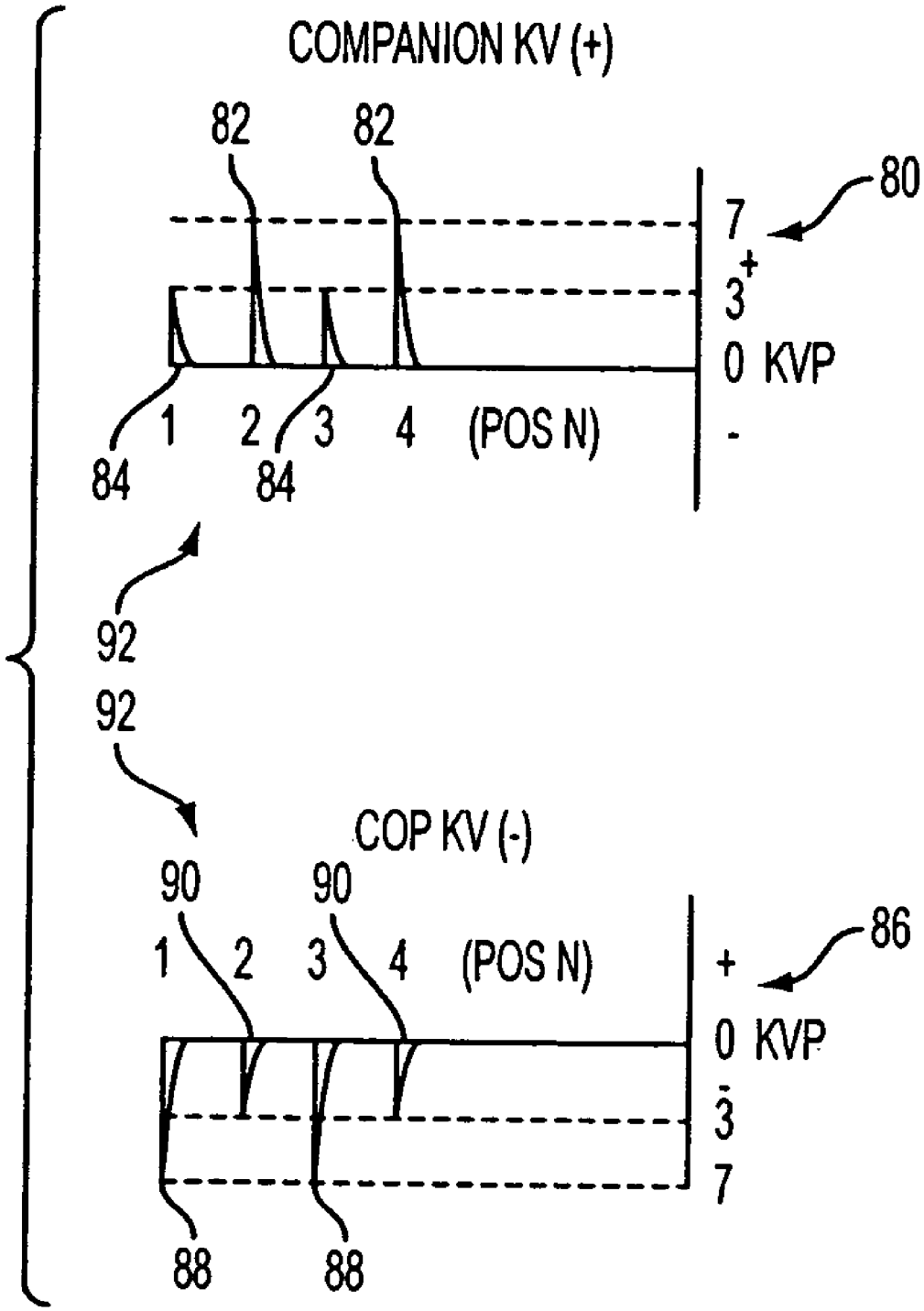
FIG. 3 is a waveform diagram showing detected voltages at each of the spark plugs associated with the system of FIG. 1.

FIG. 3 generally illustrates the waste and power stroke voltages for each of the COP spark plug 16 and the companion spark plug 18. Waveform 80 shows the power stroke voltage 82 and the waste stroke voltage 84 of the companion spark plug 18. Waveform 86 shows the power stroke voltage 88 and the waste stroke voltage 90 of the COP spark plug 16. The positions or timing at which each voltage occur are indicated at 92 in each waveform. As indicated by the signal amplitudes in FIG. 3, one spark plug (e.g., 16) is in the power stroke phase while the other spark plug (e.g., 18) is in the waste stroke phase.

Accordingly, when the rotor position 40 corresponds to the contacts 42*a*, 42*c* at positions 1 and 3 of distributor 22, the COP spark plug 16 is in the power stroke phase, meaning that the voltage output by the secondary winding 32 at first side 54 is directed to ground through rotor 40. The power stroke voltage (i.e., firing line) for the COP spark plug 16 is shown at 88 in waveform 86. Since the voltage received by the COP spark plug 16 is negative going, the power stroke voltage 88 is indicated in waveform 86 as a negative voltage. Likewise, in positions 1 and 3, the companion spark plug 18 is in the waste stroke phase. Since the voltage output by the secondary winding 32 at first side 54 is directed to ground through the rotor 40 of distributor 22, the peak waste stroke voltage for the companion spark plug 18 is reduced, as shown at 84 in waveform 80. Since the voltage received by the companion spark plug 18 is positive going, the waste stroke voltage 84 is indicated in waveform 80 as a positive voltage. In this example, the peak waste stroke voltage for the companion spark plug 18 is not an actual firing line, but instead represents the rotor spark gap 46, which provides a very good approximation of the actual firing line.

In positions 2 and 4 of the distributor 22, the operation is switched and the voltage output by secondary winding 32 at second side 56 is directed to ground through the rotor 40 of distributor 22 to simulate a waste stroke phase for COP spark plug 16. The waste stroke voltage (i.e., spark gap 46 voltage) for the COP spark plug 16 is shown at 90 in waveform 86. Likewise, when the rotor position 40 corresponds to the contacts 42*b*, 42*d* at positions 2 and 4 of the distributor 22, the companion spark plug 18 is in the power stroke phase. The power stroke voltage for the companion spark plug 18 is shown at 82 in waveform 80.

In this example, as indicated in FIG. 3, the detected power stroke voltage for both spark plugs 16, 18 is approximately 7 KV and the detected waste stroke voltage for both spark plugs 16, 18 is approximately 3 KV. Since these are the values at which the power stroke voltage and waste stroke voltage were set, it can be confirmed that the CUT 12 is operating properly. If the power stroke voltage or waste stroke voltage of either spark plug 16, 18 were significantly different from the preset values, it can be surmised that the CUT 12 is not operating properly.

Figure 4:
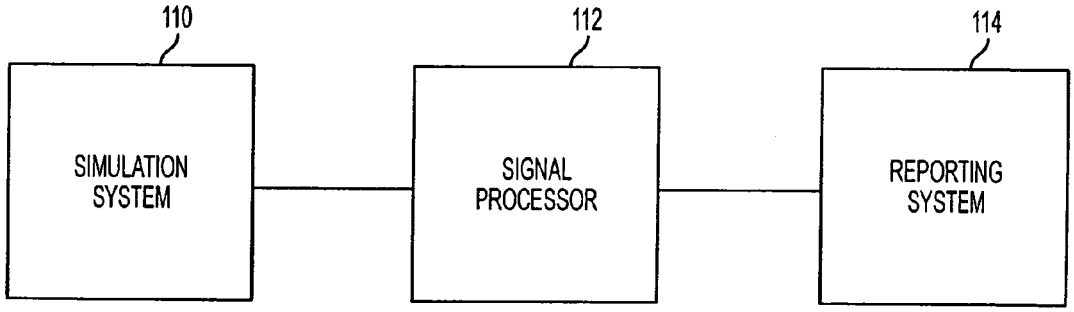
FIG. 4 illustrates a diagnostic system for detecting and reporting on the voltages within the simulation system in accord with the present concepts.

FIG. 4 illustrates a diagnostic system for testing and reporting on the voltages that are generated by the simulation system 10. As shown in FIG. 4, a testing apparatus or simulation system 110, such as described above, may be connected to one or more conventional signal processors 112 and/or amplifiers, or wave shaping circuits, to extract, filter or emphasize any particular portion of portions of the signals from the simulation system.

The output of simulation system 110 and/or signal processor 112 is provided to a reporting system 114. The reporting system 114 could include a lab scope or trace scope that displays the waveforms emanating from the simulation system 110 and associated amplifier or signal processor 112, if provided. Reporting system 114 could also provide numerical values or other representation of the data output by the simulation system 110 for some or all of the important ignition parameters, such as burn time, firing line and spark line. Further details on such analyses are set forth in U.S. Pat. No. 6,396,277, the content of which is incorporated herein by reference in its entirety. As noted above, the reporting system 114 may comprise any conventional engine analyzer, lab scope, ignition scope, or display, such as but not limited to a Snap-On® Vantage®/KV Module (EETM306A) or Snap-On® MODIS® module, commercially available from Snap-On Diagnostics in San Jose, Calif., and may further comprise a computer and local area network.

Although the simulation system 110 is described such that the COP spark plug 16 receives a negative-going voltage and the companion spark plug 18 receives a positive-going voltage, the polarity of the voltages may be switched without affecting the operation of the simulation system as described. The voltages shown in FIG. 3 would likewise be switched. Furthermore, although in the description, the CUT 12 is described as a hybrid ignition coil, it will be understood that a DIS coil that controls a pair of non-COP spark plugs may also be tested with the system.

As noted above, in the illustrated example, the peak waste stroke voltage for the companion spark plug 18 is not an actual firing line, but instead represents the rotor spark gap 46, which provides a very good approximation of the actual firing line. In another aspect of the present concepts, the actual waste spark firing line may be obtained, as follows. The distributor cap 22 may be inverted and filled with an epoxy, or other similarly malleable or fluid non-conductive material, to a level slightly above the four contacts 42*a–d* that are routed to spark plugs 16, 18 after installation of a temporary dam to contain the epoxy between the contacts and the adjacent inside walls of the cap. Using a suitable jig, the epoxy is machined to expose all four metal contacts 42*a–d*. The resulting cylindrical surface then becomes a wall upon which a metal spring contact affixed to the end of the rotor 40 can ride, thereby providing a high voltage four position rotary switch. Instead of grounding the center contact of the cap 22, the center contact is connected an adjustable spark gap. In this configuration, the prior spark gap between the rotor-end and the cap 22 contacts 42*a–d*, becomes a solid connection so that the adjustable spark gap setting is now the waste spark firing line instead of the rotor spark gap 46. Other conventional high voltage switches may also be provided and may comprise any conventional high voltage rotary switch(es) or high voltage switches arranged for sequential operation.

It also bears noting that the distributor 22 may be replaced by alternative conventional mechanical, electrical, or electromechanical switching means adapted to the same effect. For example, a high-voltage solid-state switching system may be controlled, either manually or by a computer, to effect switching of the secondary winding 32 first side 54 and second side 56, as described.

The embodiments described herein may be used with any desired system or engine. Those systems or engines may comprise items utilizing fossil fuels, such as gasoline, natural gas, propane and the like; non-fossil fuels, such as hydrogen or ethanol; electricity, such as that generated by battery, magneto, solar cell and the like; wind and hybrids; or combinations of the above. Those systems or engines may be incorporated into other systems, such as an automobile, a truck, a boat or ship, a motorcycle, a generator, an airplane and the like.

I claim:

1. A testing apparatus for testing a waste-power ignition coil, the testing apparatus comprising:

a first power source connectable to a primary side of a waste-power ignition coil under test;

an ignition simulator comprising an actuator and a switching device having a first state, in which an output of the primary side of a waste-power ignition coil under test is electrically connected to ground to permit current to flow through the primary winding and having a second state, in which the output of the primary side of a waste-power ignition coil under test is electrically disconnected from ground to prevent current flow through the primary side of the waste-power ignition coil under test;

a distributor comprising a rotor and a rotor cap, the rotor cap comprising a plurality of contacts, a first pair of opposing contacts being electrically connected to a first output of the secondary side of the waste-power ignition coil under test and a second pair of opposing contacts being electrically connected to a second output of the secondary side of the waste-power ignition coil under test;

a second power source; and a motor connected to the second power source, the motor having an output shaft configured to rotate the actuator and rotor;

wherein the rotor comprises a point at a distal end thereof disposed to travel adjacent each of the plurality of distributor rotor cap contacts and to be separated therefrom by a predetermined rotor gap;

wherein the actuator is disposed proximal to the switching device to switch the switching device between the first state and the second state in accord with a rotation of the actuator, and wherein the rotor acts synchronously with the actuator to ground a respective one of first output and the second output of the secondary side of the waste-power ignition coil under test to simulate a waste-stroke phase for an associated spark plug and to provide a voltage from another of the first output and the second output of the secondary side of the waste-power ignition coil under test to simulate a power-stroke phase for an associated spark plug.

2. A testing apparatus for testing a waste-power ignition coil in accord with claim 1, the testing apparatus further comprising:

a voltage detection system configured to detect a voltage output from the secondary winding.

3. A testing apparatus for testing a waste-power ignition coil in accord with claim 1, wherein the rotor gap is adjustable.

4. A testing apparatus for testing a waste-power ignition coil in accord with claim 3, wherein the rotor gap is adjustable to obtain an average waste power voltage of between about 2–4 KVp.

5. A testing apparatus for testing a waste-power ignition coil in accord with claim 4, wherein a spark plug gap of each of the first spark plug and second spark plug is set to obtain an average breakdown voltage of between about 6–10 KVp.

6. A testing apparatus for testing a waste-power ignition coil in accord with claim 5, wherein the distributor is a four cylinder, external coil type.

7. A testing apparatus for testing a waste-power ignition coil in accord with claim 6, wherein the first pair of opposing contacts is electrically connected to a negative going output of the secondary coil of the waste-power ignition coil under test, and wherein the second pair of opposing contacts is electrically connected to a positive going output of the secondary coil of the waste-power ignition coil under test.

8. A testing apparatus for testing a waste-power ignition coil in accord with claim 5, wherein the switching device is a FET, wherein the igniter simulator comprises an inductor disposed adjacent the igniter simulator actuator, wherein the igniter simulator actuator comprises a plurality of magnetic poles that produce a flux and induce a current flow within the adjacent inductor to provide a voltage to power the FET in accord with a rotation of the motor output shaft.

9. A testing apparatus for testing a waste-power ignition coil in accord with claim 5, wherein the first power source and the second power source consist of a single DC power source configured to both power the DC motor and to provide a predetermined voltage to the primary coil of the waste-power ignition coil under test, wherein the voltage supplied to the primary coil of the waste-power ignition coil under test is maintained within a range of about 0.15 VDC about the pre-determined voltage.

10. A testing apparatus for testing a waste-power ignition coil in accord with claim 3, wherein the rotor gap is adjustable to obtain an average waste power voltage of about 3 KVp, and wherein a spark plug gap of each of the first spark plug and second spark plug are set to obtain an average breakdown voltage of between about 7 KVp.

11. A testing apparatus for testing a waste-power ignition coil, the testing apparatus comprising:

an igniter simulator comprising a first switching device electrically connected to an output of the primary side of a waste-power ignition coil under test and a triggering means for changing a state of the first switching device at a predetermined interval;

a second switching device bearing a first pair of contacts being electrically connected to one of a positive going and negative going output of a secondary winding of the waste-power ignition coil under test and a second pair of contacts being electrically connected to another of a positive going and negative going output of the secondary winding of the waste-power ignition coil under test, wherein the second switching device acts substantially synchronously with the igniter simulator actuator to ground a respective one of the positive going and negative going output of the secondary winding of the waste-power ignition coil under test to simulate a waste-stroke phase.

12. A testing apparatus for testing a waste-power ignition coil in accord with claim 11, wherein the second switching device is configured to obtain an average waste power voltage of between about 2–4 KVp.

13. A testing apparatus for testing a waste-power ignition coil in accord with claim 12, further comprising:

a first spark plug connected to one of a positive going and negative going output of a secondary winding of the waste-power ignition coil under test; and a second spark plug connected to another of a positive going and negative going output of the secondary winding of the waste-power ignition coil under test;

wherein a spark plug gap of each of the first spark plug and second spark plug is set to obtain an average breakdown voltage of between about 6–10 KVp.

14. A testing apparatus for testing a waste-power ignition coil in accord with claim 12, wherein the second switching device is adjustable.

15. A testing apparatus for testing a waste-power ignition coil in accord with claim 14, wherein the second switching device comprises a distributor comprising a rotor and a rotor cap bearing a plurality of contacts.

16. A method for testing a waste-power ignition coil, comprising the steps of:

electrically connecting an input terminal of a waste-power ignition coil primary coil to a power supply;

electrically connecting a first switching device to an output terminal of the waste-power ignition coil primary coil;

electrically connecting a negative going output of the waste-power ignition coil to a first spark plug;

electrically connecting a positive going output of the waste-power ignition coil to a second spark plug;

electrically connecting a second switching device to each of the positive going output of the waste-power ignition coil and the negative going output of the waste-power ignition coil;

operating the first switching device to intermittently, at a pre-selected interval, connect the output of the waste-power ignition coil primary coil to ground;

operating the second switching device to, substantially simultaneously with the operation of the first switching device, intermittently and alternately ground the positive going output and the negative going output of the waste-power ignition coil to simulate a waste-stroke phase for the grounded output and associated spark plug and to simulate a power-stroke phase for the non-grounded output.

17. A method for testing a waste-power ignition coil in accord with claim 16, further comprising the step of:

measuring a voltage of at least one of the negative going output and positive going output of the waste-power ignition coil.

18. A method for testing a waste-power ignition coil in accord with claim 17, further comprising the steps of:

measuring a voltage of the negative going output of the waste-power ignition coil; and measuring a voltage of the positive going output of the waste-power ignition coil.

* * * * *